United States Patent [19]

Maurer et al.

[11] Patent Number: 4,527,302

[45] Date of Patent: Jul. 9, 1985

[54] CANISTER CLEANER

[75] Inventors: Edgar A. Maurer, Canton; John D. Essex, North Canton, both of Ohio

[73] Assignee: The Hoover Company, North Canton, Ohio

[21] Appl. No.: 553,972

[22] Filed: Nov. 21, 1983

[51] Int. Cl.[3] ..... A47L 5/36

[52] U.S. Cl. ..... 15/325; 15/327 R; 15/327 F

[58] Field of Search ..... 15/327 R, 327 F, 327 E, 15/323, 327 D, 325

[56] References Cited

U.S. PATENT DOCUMENTS

| | | | |
|---|---|---|---|
| 2,987,241 | 6/1961 | Lindsjo et al. | 15/327 R X |
| 3,619,850 | 11/1971 | Rideout et al. | 15/327 F X |
| 3,651,536 | 3/1972 | Bolzan et al. | 15/327 F X |
| 3,835,626 | 9/1974 | Miyake et al. | 15/327 R X |
| 4,199,839 | 4/1980 | Martinec | 15/377 X |

*Primary Examiner*—Chris K. Moore

*Attorney, Agent, or Firm*—Gerald H. Kreske; Richardson B. Farley

[57] ABSTRACT

The invention comprehends a canister type cleaner having an intermediate piece which extends over the major horizontal extent of the cleaner and is utilized for bag chamber forming and operating element support.

7 Claims, 8 Drawing Figures

34
244
248
104
106
246
58
104
106
10
136
214
135
52
212
66
36
234
236
232
224
24
225
-50-
12
230
216
228
226
240
-48-
242
46
238
26
174
172
178
176
250
25
138
180

CANISTER CLEANER

BACKGROUND OF THE INVENTION

1. Field of the Invention

The invention relates to canister cleaners and, more specifically, relates to a canister cleaner having an intermediate piece that lies between the bottom shell and top shell of the cleaner and has a relatively large horizontal extent.

2. Description of the Prior Art

Although it is known to provide an intermediate member to form a bag cavity and thereby provide for exhaust air flow between the intermediate member and the outer shell, no one heretofore has provided an intermediate member that not only forms a bag cavity but also extends over the remainder of the cleaner to be interposed between the top shell and bottom shell to thereby be positioned to serve a variety of functions and purposes.

Obviously, the use of a minimum number of parts to form a functioning canister cleaner results in lower costs and thereby better consumer acceptance. To this end, the use of the described intermediate member permits a reduction in assembly time and in parts since it, itself, fulfills several functions within the canister cleaner.

Accordingly, it is an object of this invention to provide an enlarged intermediate member for a canister cleaner that has a substantial horizontal extent.

It is an additional object of the invention to provide an intermediate member that extends for substantially the full lateral and linear extent of a canister cleaner bottom shell.

It is a further object of the invention to provide an open bag cavity with the intermediate member.

It is a still further object of the invention to form shaped sections in the intermediate member for the reception of, for example, the cord reel and/or motor.

It is an even further object of the invention to locate the intermediate member relative to the bottom shell by a locating hole in the bottom shell.

SUMMARY OF THE INVENTION

The invention contemplates a canister cleaner with a lower upwardly opening shell and a top shell, formed in this instance by a bag lid and a control containing rear panel or deck. Disposed between these two shells is an intermediate member or main frame which extends substantially the full linear and lateral extent of the upper and lower shells. The main frame, at its forward end, provides an open, shaped bag cavity including provision for mounting a bag latch on its front wall. Its rear bag cavity wall includes an aperture for air flow to the motor-fan system and on which is mounted a secondary filter. Rearward portions of the main frame include a stepped partially cylindrical shape to form upper portions of a motor-fan housing, joined to the rear bag wall, and a partially cylindrical open trough shape having its axis at 90° to the axis of the stepped partially cylindrical shape to house a cord reel.

A bottom surface of the lower shell includes an enlarged aperture of generally rectangular shape. In turn, the main frame includes at its bottom outside an enlarged short height rectangular protuberance. This protuberance fits closely into the aperture so that the lower shell and main frame are fixedly located relative to one another in a horizontal direction and downward vertical direction.

The canister cleaner utilizes a conventional motor-fan with a through flow air system. The rear of the motor housing includes a semi-cylindrically shaped baffle directly in line with the air flow and against which air impinges so as to flow up and over the cylindrical sides and then downwardly and forward below the motor-fan housing and thence between the generally vertical sides of the lower shell and intermediate member, to be discharged at the sides of the lower shell or housing through convenient louvers.

A suction connection is provided at the forward wall of the canister cleaner which communicates with the bag cavity through a tubular inwardly extending piece. A bag lid latch and hinge is included for the bag lid while a rear deck or panel may include controls or the like. A central caster and rear wheels may be included for trundling purposes and a handle is provided at the front end of the canister cleaner.

DESCRIPTION OF THE DRAWINGS

Reference may now be had to the accompanying drawings for a better understanding of the invention, both as to its organization and function, with the illustrations being only exemplary, and in which.

DESCRIPTION OF THE PREFERRED EMBODIMENT

Figure 1:
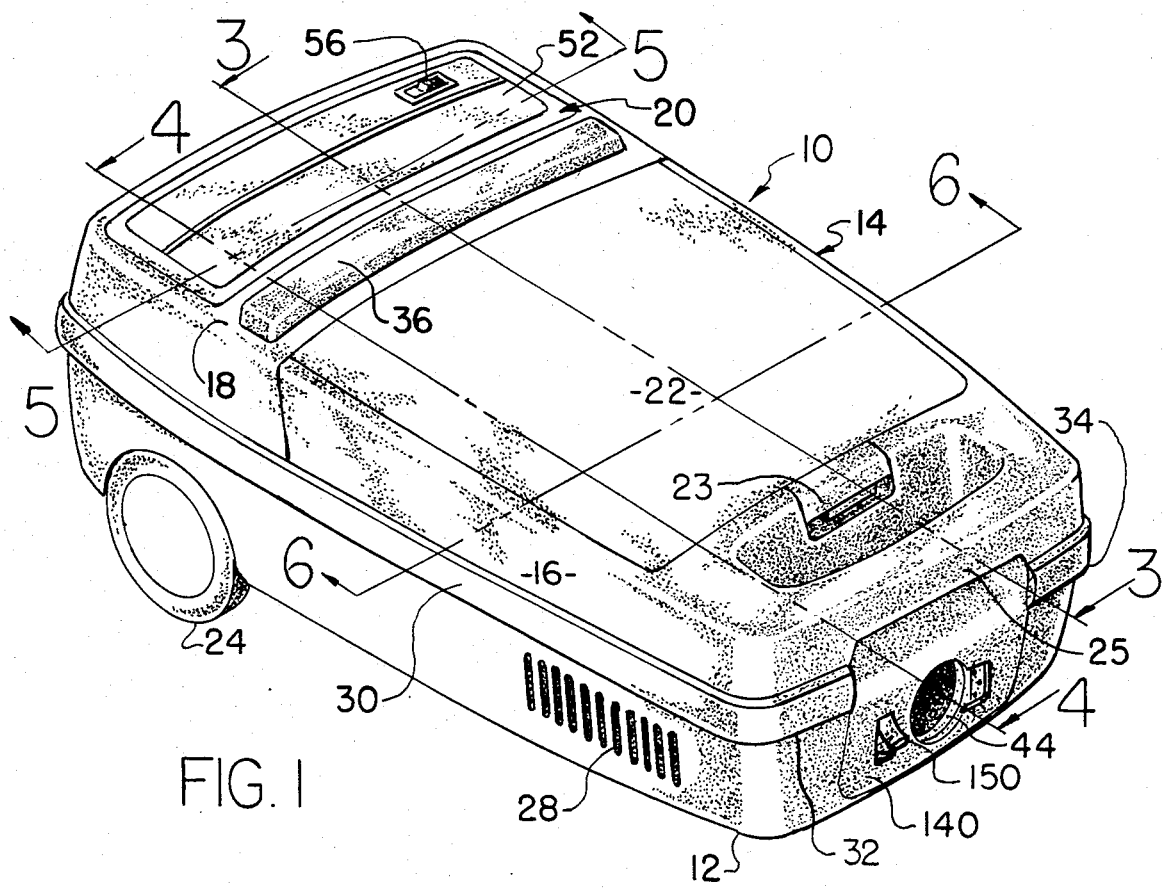
FIG. 1 is a perspective view of a floor care appliance which utilizes the invention.
Figure 5:
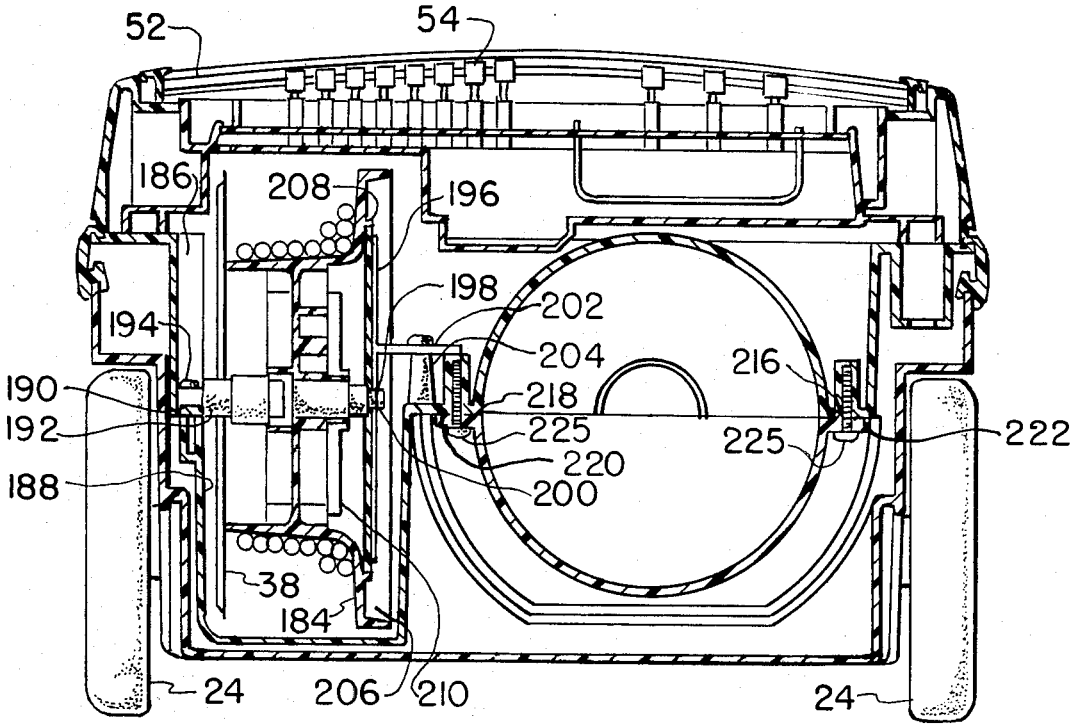
FIG. 5 is a view of the floor care appliance taken generally on line 5—5 of FIG. 1.
Figure 2:
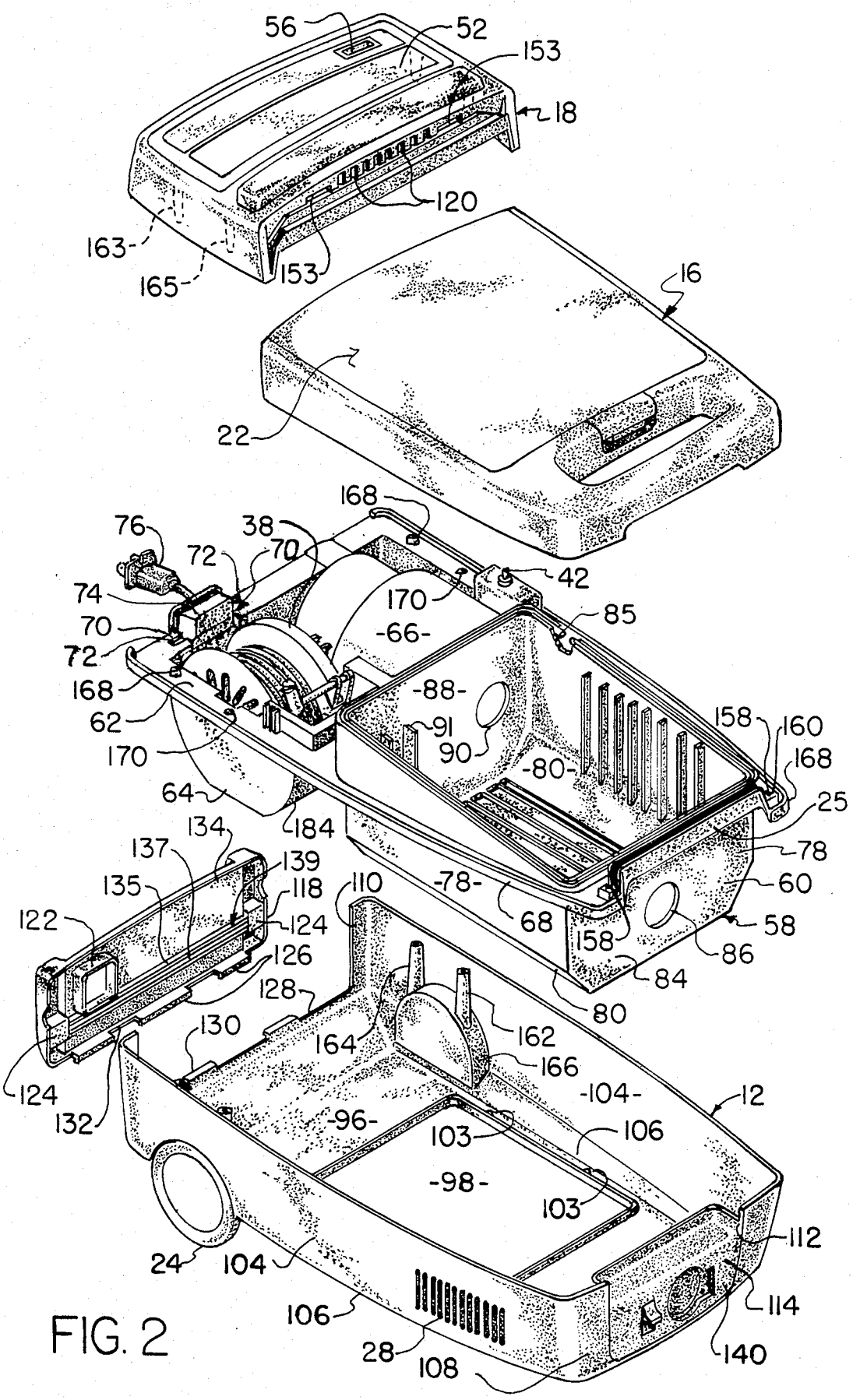
FIG. 2 is a partially exploded view, primarily of the main components of the floor care appliance of FIG. 1.

A floor care appliance or cleaner 10, with reference to FIG. 1, includes a bottom shell 12 and a top shell 14 comprising a bag compartment lid 16 and a rear deck or cover 18. The rear deck 18 may carry a series of cleaner controls 20, while the bag compartment lid 16 can include a tool tray lid 22 having a catch 23 that opens to a separate compartment in the bag compartment lid within which cleaning tools (not shown) may be stored.

Turning now to all the Figures, the cleaner 10 may also include a handle 25 and enlarged rear wheels 24, 24 and a front caster 26. On each side of the bottom shell 12 (only illustrated on one side) are disposed louvers 28 to permit the exhaust of airflow from the cleaner 10. A furniture guard 30, comprising two pieces 32, 34 extends substantially around the cleaner 10 save for portions at its front and back to protect furniture, sharp objects ot the like, from the cleaner. The cleaner controls 20 include a pedal 36 in the rear deck 18 which permits, by rocking motion, release of a cord reel 38, through its brake 40, or energization or de-energization of a push-push switch 42. A female suction connection 44 is disposed at the front end of the cleaner 10, as is conventional, for receipt of a suction hose or the like (not shown).

A motor-fan system 46 including a motor 50 and a fan 48 are disposed in the cleaner 10 to draw suction air through the suction connection 44 which is eventually discharged through the louvers 28. The motor-fan system 46 is a conventional through flow system, with air passing through the fan 48 and then the motor 50 so no further description of it is deemed necessary.

A lens 52 may be provided in the rear cover or deck 18 to permit visual read out of the condition of the, for example, speed of the motor 50 of the motor-fan system 46. A series of LED's 54 may be utilized for this or similar purposes. A switch 56 may be provided to, essentially, switch the electronic controls from manual to automatic control to meet varying suction conditions. The LED's 54 and switch 56 are, again, part of the cleaner controls 20 and are conventional in the art and only mentioned for background purposes in amplification of the invention.

The invention, itself, comprehends the use of a formed or molded intermediate structural member of main frame member 58 having an open box-like configuration 60 (bag enclosure) at its front and an integral framework 62 at its rear within which is disposed an integral upwardly opening semi-cylindrical shell 64 disposed with its axis at right angles to the axis of the main frame member 58 and disposed in transverse spaced relationship to this axis and a stepped semi-cylindrical shell 66 extending axially to the main frame member 58. An integral border or rim 68 extends around the main frame member 58 to provide a piece rectangular in cross section which extends along the sides of the intermediate or main frame 58 around its back and slightly around its front. A recess 70 is formed in the rear side of the framework 62 including side channels 72, 72 for the reception of rearwardly open box 74 that covers the recess 70 and forms a reception means for a plug 76.

At its forward end, the main frame 58 includes vertical side walls 78, 78, partially forming the open box 60, which merge with inwardly angled downward depending angular walls 80, 80 that merge into a generally flat bottom wall 82. Ribs such as ribs 83, 83 on vertical side walls 78, 78 and bottom wall 82 insure that a bag (not shown) disposed in the cavity formed by open box 60 does not seal to its sides. A gasket 85 extends completely around the top of open box 60 to serve a sealing means for the bag compartment lid 16.

A front wall 84 of open box 60 is shaped and sized to extend between the two side walls 78, 78 and is integrally joined with them. The front wall 84 includes a circular aperture 86 providing communication for the flow of suction cleaner air. A rear wall 88 completes the generally box-like configuration of open box 60. An aperture 90 in this wall provides communication between the bag receiving compartment formed and the motor-fan system 46. Ribs 91, 91 are also formed on this wall, laterally spaced from the aperture 90.

The bottom 82 of main frame member 58 includes a bottom side 93 having a rectangular, centered enlarged boss protuberance 94 of relatively small height so as to accomodate the thickness of a bottom 96 of bottom shell 12. Bottom 96 includes a corresponding flanged rectangular aperture 98 sized to permit insertion of protuberance 94 therein so that a bottom side 100 of protuberance 94 lies substantially flush with a bottom surface 102 of bottom 96 of lower shell 12. The interengagement of the flanged rectangular aperture 98 of lower shell 12 with the rectangular boss 94, when the lower shell 12 and main frame member 58 are so assembled, of course, provides positive location between these two parts and relatively securely mates them, one to the other, with the protruberance 94 forming a substantial part of the bottom of the bag cavity. These two elements are secured together in this fashion by screw containing threaded bosses 103, 103 on the bottom shell 12 which mate with similarly shaped wells 105, 105 on the main frame 58.

The bottom shell is also shaped, generally like an open box although it is slightly wedge shaped, as is the box-like portion 60 of main frame member 58, it expands toward the rear portions of the cleaner 10. It includes vertical sides 104, 104 surmounting angled sides 106, 106 so as to conform to the shape of the sides of the box-like portion 60 of main frame member 58.

Bottom shell 12 also includes a front wall 108 and a rear wall 110, with medially disposed discontinuities or openings in each of these walls. Discontinuity or opening 112, in front wall 108, receives a suction coupling structure 114, the mounting arrangement of which will be described later. Discontinuity or opening 116 provides for mounting of a rear panel 118 which is placed over the opening 116. Rear panel 118 includes a square aperture 122, laterally displaced from the center of the rear panel 118 for ingress to the cord plug box 74.

Figures 3, 6:
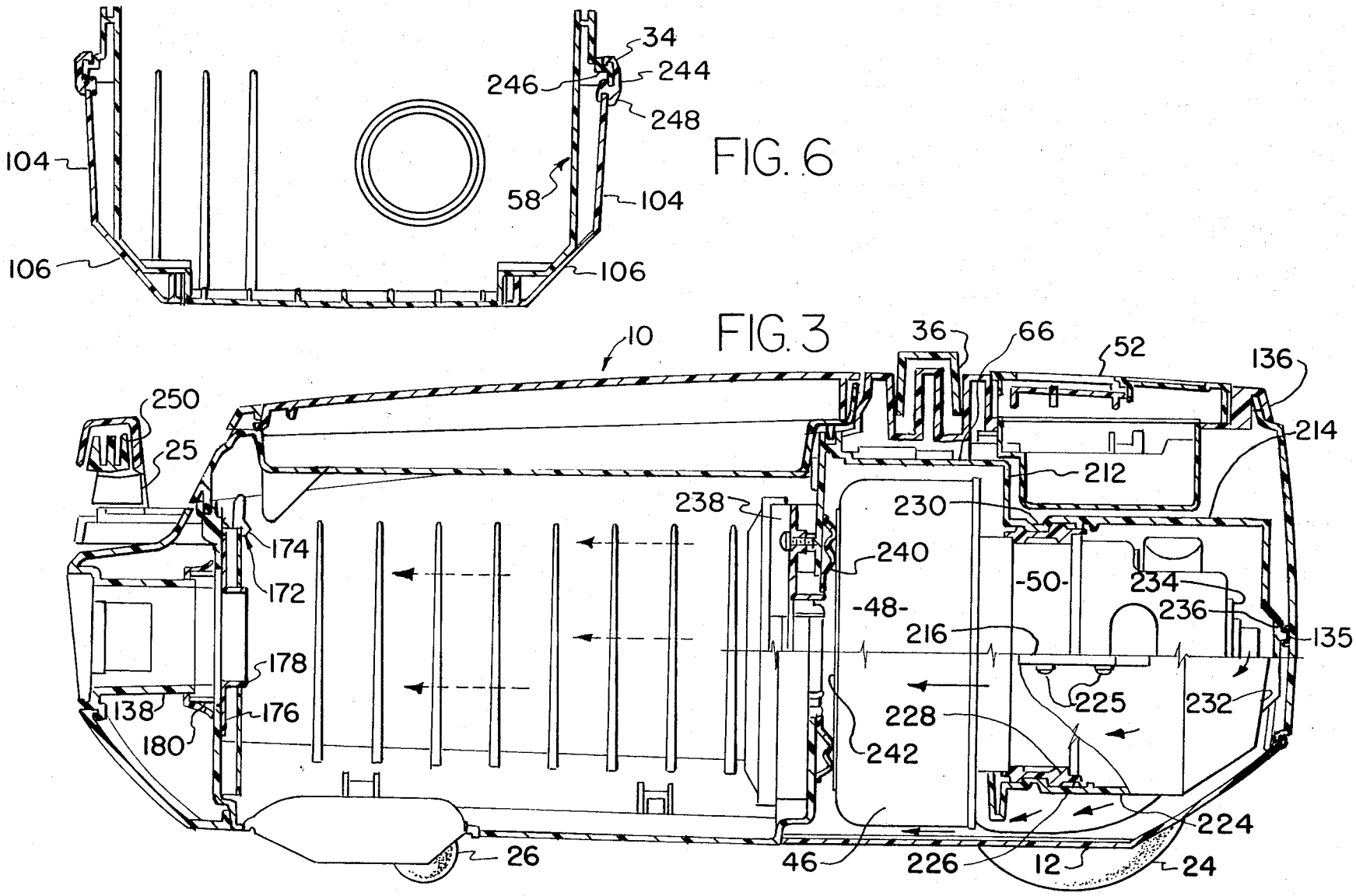
FIG. 3 is a view of the floor care appliance taken generally on line 3—3 of FIG. 1.
FIG. 6 is a partial view of the floor care appliance taken on line 6—6 of FIG. 1.
Figure 4:
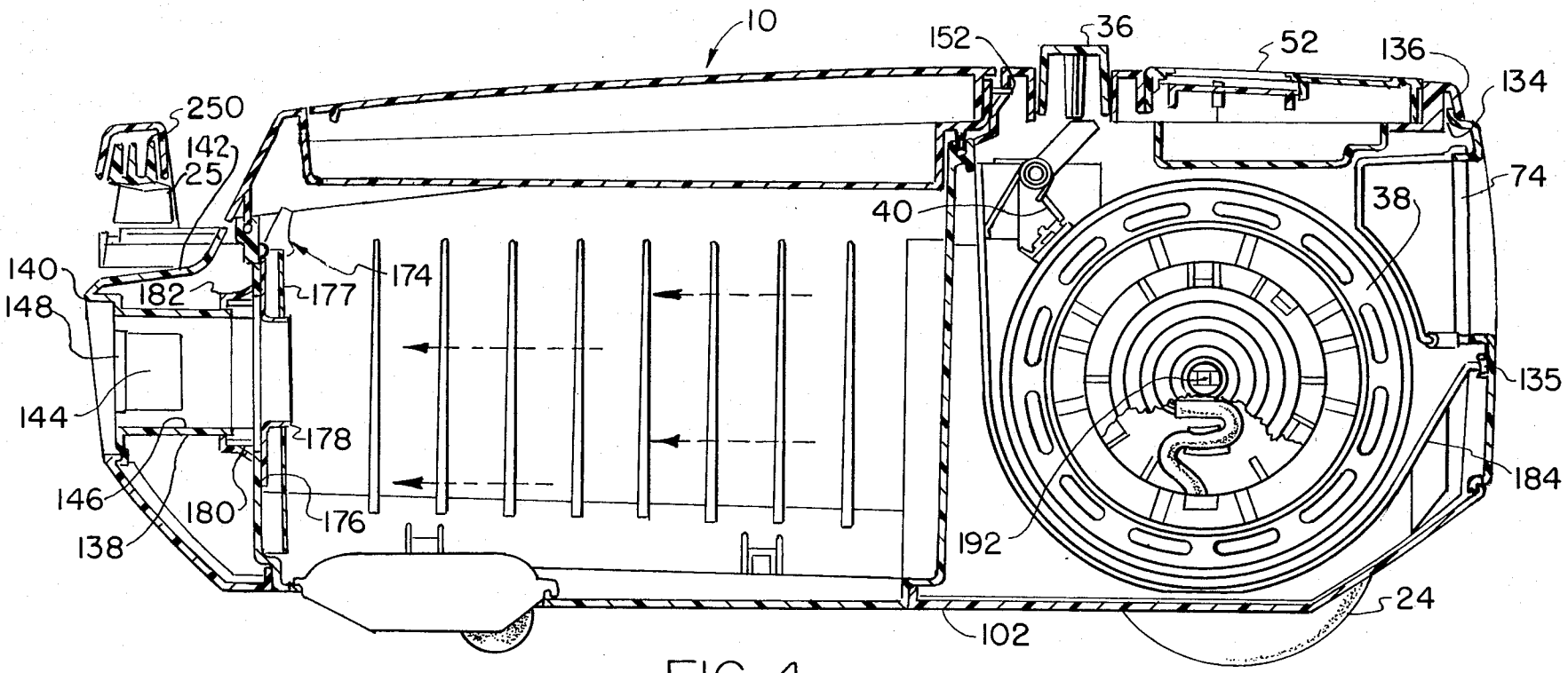
FIG. 4 is a view of the floor care appliance taken generally on line 4—4 of FIG. 1.
Figure 7:
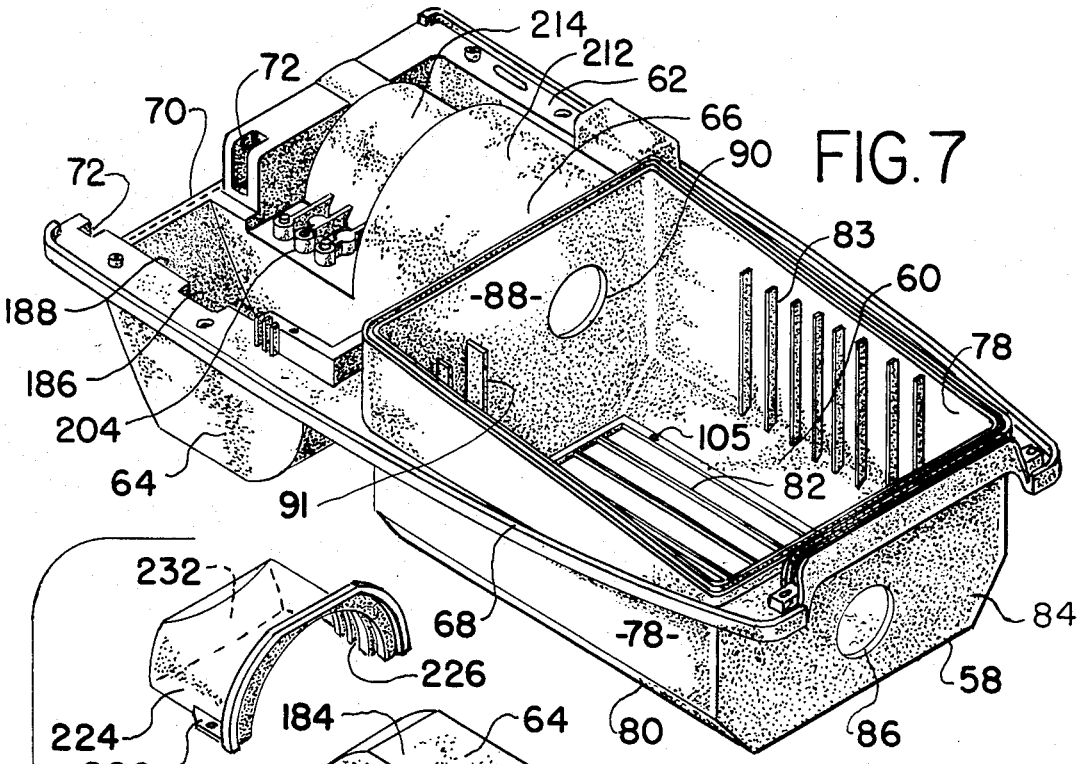
FIG. 7 is a view in perspective of the top side of the main frame.
Figure 8:
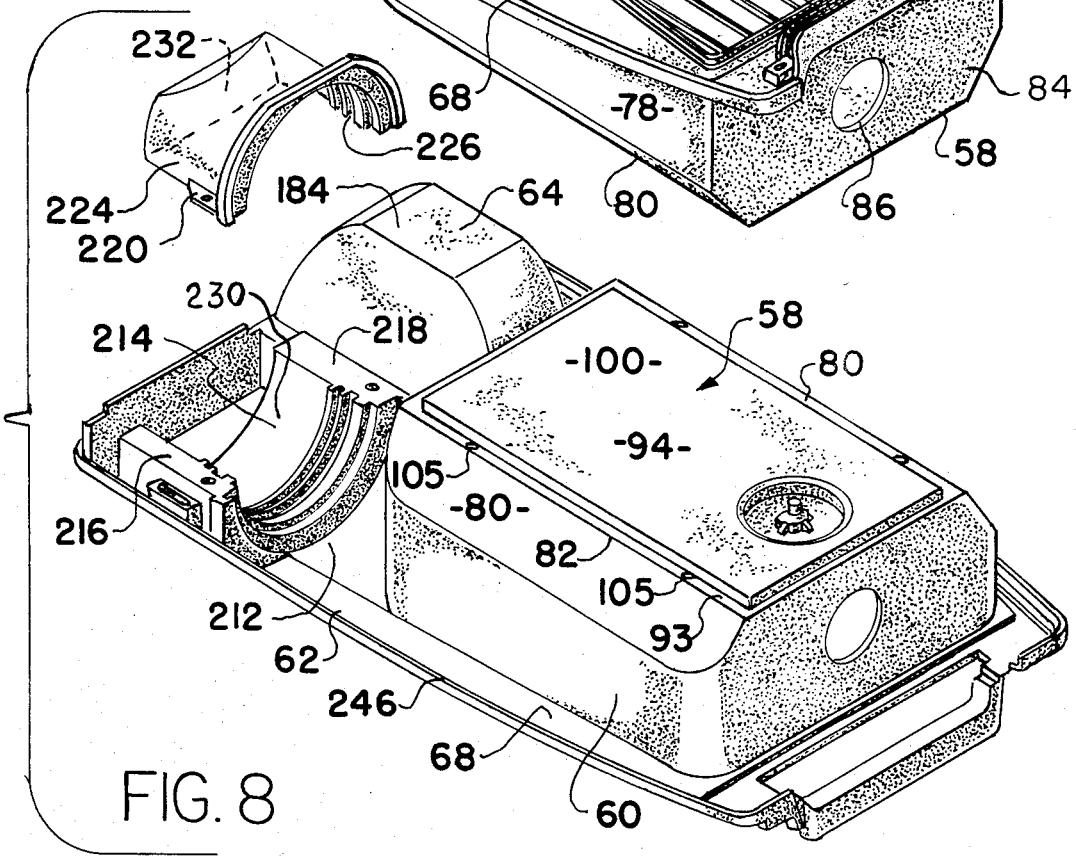
FIG. 8 is a view in perspective of the bottom side of the main frame.

A pair of foam rubber blocks 124, 124 are disposed on opposite sides of the inside of rear panel 118 to be compressed resiliently upon assembly of the rear panel 118 to the bottom shell 12. These blocks function as part of a seal as will be detailed later. To this end, a series of hinge elements 126, 126 of hook-like configuration are formed at the bottom of the rear panel 118 which engage over an intermittent lip 128 on rear wall 110 of bottom shell 12. At the same time a series of hinge elements 130, 130 of similar hood-shaped configuration on rear wall 110 engage over an intermittent lip 132 on rear panel 118. The rear panel 118 is assembled to rear wall 110 by interleaving the hinge elements 126 and 130 and placing the rear panel at an angle so that the open part of the "hooks" are adjacent the lips 128 and 132 and the rear panel 118 pivoted upwardly so that the foam rubber blocks 124, 124 are compressed resiliently between rear panel 118 and rear wall 110. A top lip 134 of rear panel 118 is then captured inwardly by a rear lip 136 of rear cover or deck 18 (FIGS. 3 and 4). An integral U-shaped channel 135 extends across rear panel 118 to house a seal 137, extending between the blocks 124, 124 so that, in toto, a rear seal 139 is formed which engages against a rear flange 73 of intermediate frame 58 and separates the cleaner air from bleed air utilized to cool the electronics of the cleaner such as diodes, etc., disposed in front of rear panel 118. To this end slots 120, 120 are disposed in a front vertical wall of rear deck 18 so that air may enter these slots through the crack between rear deck 18 and bag lid compartment 16 with the air exhausting into the bag compartment through a bleed or the like (not shown).

Turning now to forward portions of the cleaner 10, the suction coupling structure 114 is seen as comprising a molded piece including a tubular part 138, a front piece 140 and a merging section 142 extending inwardly and upwardly from upper reaches of the front piece 140 of suction coupling structure 114. The coupling structure 114 can be conventionally attached to the front of main frame member 58 by screws or the like (not shown). Coupling structure 114 may include on the internal surface a tubular part 138 a conventional relief 144 which extends partially around the circumference of a bore 146 of tubular part 138 and along its axis for a short depth. Within this relief is lodged a lug (not shown) on a suction hose (not shown) for remote connection to a cleaning tool (not shown).

Disposed in front of relief 144 is a reciprocating locking member 148 which is spring (not shown) urged into projection position into bore 146. An upwardly and downwardly reciprocating slide button 150 cams the locking member 148 out of projecting position in bore 146 to permit insertion of the suction hose (not shown). This locking structure is conventional and may be found on a cleaner denoted the SELECTRONIC TM cleaner, made by the assignee's French affiliate, and marketed in the United States. Thus, no further description of this locking arrangement is offered here.

The bag compartment lid 16 is pivoted to rear deck 18 by means of a pair of rearwardly extending flat lugs 152 (only one shown) which engage conventionally in slots 153, 153 in a forward wall 154 of rear deck 18. The bag compartment lid 16 may be locked in closed position, at its front, by conventional spring catches (not shown) attached to the bag compartment lid 16 and disposed on opposite sides of the cleaner 10.

As set forth before, the main frame 58 is located by rectangular aperture 98 in bottom shell 12. It is maintained in this position by the use of screw connection between the bottom shell 12, main frame member 58 and rear deck 18. To this end, a pair of aperture bosses 162, 164 are formed in each rear wheel well 166 of bottom shell 12. In cleaner assembled condition, the holes in bossess 162, 164, each align with a screw hole 168 and a screw hole in a short boss 170, respectively, in rear frame 62 of main frame member 58. On the inside of rear deck 18, on each side are provided a pair of bosses 163, 165. These bosses contain threaded screw holes 167, 169 so that screws passed through bottom shell 12 and then through rear frame 62 of main frame member 58 and then into rear deck 18 can adequately maintain the cleaner 10 in assembled condition. Thus, the use of a positioned main frame generally limit assembly time and screw fasteners since only four screws are necessary, at the rear, to form the total shell configuration of the cleaner 10.

A bag lock arrangement 172 including a spring urged catch 174 is provided. It includes a plate member 176 formed with an inner tubular piece 178 on which the bag (not shown) is mounted and an outer communicating tubular piece 180 which inserts in a truncated conical seal 182 carried by the tubular part 138 of suction coupling structure 114. The plate 176 of bag lock arrangement 172 is attached to the inside of front wall 84 of box portion 60 by screws or the like (not shown). Thus, fluent communication is had between the dirt collecting bag (not shown) and the front portion of suction connection 44, while, at the same time, a means is provided for securing a bag collar 177 to this same connection.

The rear frame 62 of main frame member 58 includes within and integrally attached to it generally the generally semi-cylindrical portion 64 with the axis of the semi-cylinder, as set out before, 90° to the axis of the main frame member; this semi-cylindrical portion forms a housing section 184 for nesting and receipt of the cord reel 38. A well 186, formed in an outer side wall 188 of housing section 184, opens to the cord reel 38 and provides by its bottom 190 a seating means for reception of an axle 192 of cord reel 38. A screw 194 passes through axle 192 and bottom 190 of well 186 to secure the axle end fixed in a non-rotational manner relative to the cleaner 10.

The other end of axle 192 is non-rotationally mounted in a circular end plate 196 by having a square or rectangular cross section 198 at this end and being inserted in a similarly shaped hole 200 in circular end plate 196. The circular end plate 196, in turn, is fixedly attached to the cleaner 10 by an integral tab 202 that is fixed to a boss 204 upwardly disposed and integral with the main frame member 58. A discontinuity or enlarged bore 206 in the inner wall of cord reel housing 184 permits the mounting of circular end plate 196 and outwardly extending portions of its tabs within a flange 208, at which location of it may conveniently carry a brush block (not shown) for electrical contact with commutator ring block 210.

The motor-fan shape 66, as set out previously, is a stepped generally semi-cylindrical shape with a larger cylindrical portion 212 forming a half enclosure for the fan 48 and a smaller diameter, semi-cylindrical rear portion 214 forming a half enclosure for the motor 50. Disposed on opposite sides of the cylindrical portion 214 and at its bottom termination and mediate relative to the fore and aft direction the cylindrical shape is thickened to form a pair of flats 216 and 218. The flats 216, 218 provide a convenient abutting surface for a pair of integral wing-like projections 220, 222 formed on a separate semi-cylindrical clamping piece 214. These wings extend both axially and transversely of the clamping piece 224 and receive screws 225 and 225 to abutting clamp, clamping piece 224 to flats 216, 218. The semi-cylindrical shape of clamping piece 224 completes the housing for the motor 50 so as to provide sound deadening and includes an irregular stepped portion 226, at its front end, to form a series of grooves to compressingly capture a similarly shaped, elastomeric generally doughnut shaped, resilient support member 228. The large cylindrical part 214 (the motor housing) of motor-fan shape 66 has a similar stepped portion 230, opposite to stepped portion 226 of clamping piece 224, also to capture the elastomeric piece 228. As can be seen, the motor-fan system 46 is spaced from the just described formed housing by elastomeric piece 228 and also from the bottom shell 12. This also reduces noise and vibration.

The clamping piece 224 also includes a rear capped end forming a half baffle 232 spaced from an air discharge face 234 of motor 50. The main frame 58 also includes a wall 236 forming the remainder of the baffle for discharge air after it flows through fan 48 and motor 50. Thus, suction air is dumped around the baffle 232 (see arrow) so that it may pass alongside and beneath the motor-fan system 46 (arrows) to then pass between the side walls of the main frame 58 and bottom shell 12 (arrows) to discharge through the louvers 28 (arrows).

Suction air, of course, enters the cleaner 10 through suction connection 44, passes through the bag (not shown) to exhaust to the fan 48 through the aperture 90 in rear wall 88 of main frame 58. A secondary filter 238 is disposed in the bag cavity over the aperture 90 and attached conventionally to the rear wall 88. A seal 240, on the other side of this wall insures no leakage at a forward fan face 242.

The furniture guard 30 is attached to the cleaner 10 by providing it with a tailed C-shaped cross section 244 (FIG. 6) which resiliently hooks around a rail 246, integral with main frame member 58 and extending primarily along its sides so as to be mounted securely thereto. A tail 248 of C-shaped cross section 244 extends past the parting line between bottom shell 12 and main frame member 58. Thus, a handy furniture rail mounting arrangement is also afforded by main frame member 58.

The furniture guard 30 serves as a seal between the bottom shell 12 and main frame 58 by overlapping their parting line. Thus, in conjunction with the rear seal 139, a sealed flow path is provided for motor discharge to the louvers 28, and this primarily by sealing the main frame 58 from the bottom shell 12.

The handle 25 is attached integrally with the front of the main frame member 58. It is offset upwardly at a medial portion 250 to provide a convenient grasping arrangement and as seen, for example, in FIG. 4 serves fully its intended purpose.

The invention described, obviously, fulfills the objects set out at the beginning portion of the description. A main frame member 58 is provided to form the primary structural member, with this member extending substantially the full lateral and lineal extent of the cleaner 10. This member, at its rear, mounts to the lower shell and rear cover which, with the rectangular locating aperture, serves along with front screws as the only securement holding these parts together. The main frame member 58 also serves as the mounting means for the primary elements, the cord reel 48 and motor-fan system 46. This advantageous arrangement, as described, will suggest many obvious modifications to one skilled in the art which will still fall within the spirit and purview of the disclosure presented.

What we claim is:

1. A canister cleaner including a bottom shell and an intermediate member including;

(a) said bottom shell having an enlarged non-circular aperture through its bottom portions, (b) said intermediate member forming a bag cavity and having an enlarged non-circular projecting portion on its bottom side closely interfilling with said aperture whereby said intermediate member and bottom shell are positively located relative to one another.

2. The canister cleaner of claim 1 wherein;

(a) a furniture guard is attached to one of said bottom shell and said intermediate member, (b) said furniture guard sealingly covering a juncture between said bottom shell and said intermediate member and extending substantially therealong, and (c) a means for sealing rear portions of said bottom shell and said intermediate member.

3. The canister cleaner of claim 1 wherein;

(a) said intermediate member includes a shaped section for a fan and motor displaced from said enlarged non-circular projecting portion.

4. The canister cleaner of claim 1 wherein;

(a) said intermediate member is of generally open box-shape, terminating downwardly in said enlarged non-circular projecting portion, (b) said open box-shape forming said bag cavity.

5. The canister cleaner of claim 1 wherein;

(a) said intermediate member is of generally open box shape to form said bag cavity, (b) said bottom shell is of generally open box shape, (c) said intermediate member disposed in said bottom shell, (d) whereby said canister cleaner provides dual wall construction for its bag cavity except at said aperture adjacent said bottom side of said intermediate member.

6. A canister cleaner including a bottom shell and an intermediate member including;

(a) said bottom shell having an enlarged non-circular aperture through its bottom portions, (b) said intermediate member forming a bag cavity and having an enlarged non-circular projecting portion on its bottom side closely interfilling with said aperture whereby said intermediate member and bottom shell are positively located relative to one another, (c) said projecting portion forming a substantial part of a bottom of said bag cavity.

7. A canister cleaner including a bottom shell and an intermediate member including;

(a) said bottom shell having an enlarged non-circular aperture through its bottom portions, (b) said intermediate member forming a bag cavity and having an enlarged non-circular projecting portion on its bottom side closely interfilling with said aperture whereby said intermediate member and bottom shell are positively located relative to one another, (c) said projecting portion forming a substantial part of a bottom of said bag cavity, and (d) a bottom side of said projecting portion lying substantially flush with a bottom surface of said bottom shell.

* * * * *